US005425970A

United States Patent [19]

Lahrmann et al.

[11] Patent Number: 5,425,970

[45] Date of Patent: Jun. 20, 1995

[54] PROCESS FOR THE PRODUCTION OF MULTI-COAT LACQUER COATINGS

[75] Inventors: Edgar Lahrmann, Vienna, Austria; Stefan Drüeke, Wuppertal, Germany

[73] Assignee: Herberts Gesellschaft mit beschrankter Haftung, Germany

[21] Appl. No.: 58,481

[22] Filed: May 6, 1993

[30] Foreign Application Priority Data

May 7, 1992 [DE] Germany ..... 42 15 070.1

[51] Int. Cl.[6] ..... B05D 7/16; B05D 1/38; B05D 3/02

[52] U.S. Cl. ..... 427/493; 427/379; 427/407.1; 427/409; 427/508; 427/517

[58] Field of Search ..... 427/493, 409, 407.1, 427/379, 496, 517, 508

[56] References Cited

U.S. PATENT DOCUMENTS

| | | | |
|---|---|---|---|
| 4,173,682 | 11/1979 | Noomen et al. | 428/243 |
| 4,511,596 | 4/1985 | Berner | 427/493 |
| 4,571,316 | 2/1986 | Naruse et al. | 264/24 |
| 4,605,465 | 8/1986 | Morgan | 156/273.3 |
| 4,855,165 | 8/1989 | Bolgiano et al. | 427/412.1 |
| 4,904,536 | 2/1990 | Livesay | 427/517 |
| 4,933,214 | 6/1990 | Sugiura et al. | 427/379 |
| 4,943,447 | 7/1990 | Nelson et al. | 427/379 |
| 4,997,717 | 5/1991 | Rembold | 427/405 |
| 5,106,651 | 4/1992 | Tyger et al. | 427/379 |
| 5,194,292 | 3/1993 | Billings | 427/493 |
| 5,288,526 | 2/1994 | Hogan et al. | 427/508 |
| 5,326,596 | 7/1994 | Kasari et al. | 427/379 |

FOREIGN PATENT DOCUMENTS

| | | | |
|---|---|---|---|
| 1297610 | 5/1987 | Canada . | |
| 2947597 | 11/1980 | Germany | 427/493 |
| 62-110782 | 5/1987 | Japan . | |

OTHER PUBLICATIONS

WPI 87-181392/26, Derwent Abstract of JP62110782, May 1987.

*Primary Examiner*—Diana L. Dudash

*Attorney, Agent, or Firm*—Merchant, Gould, Smith, Edell, Welter & Schmidt

[57] ABSTRACT

A process is described for the production of multi-coat lacquer coatings in which at least one heat-curable clear lacquer coat is applied onto a substrate provided with a pigmented base lacquer coat and is thermally cured, on top of which is applied a further clear lacquer coat based on radiation-curable coating compositions and this is cured by the action of actinic radiation. Lacquer coatings of particularly good optical quality are obtained.

5 Claims, No Drawings

PROCESS FOR THE PRODUCTION OF MULTI-COAT LACQUER COATINGS

The invention relates to a process for the production of multi-coat lacier coatings with a multi-coat clear laquer coating, wherein the upper clear lacier coat is based on a radiation-curing clear lacquer.

Present-day mass-produced automotive lacquer coatings mainly consist of a clear lacquer/base lacquer topcoat which is applied to an electrophoretically primed and filler coated vehicle body. In this process, the base lacquer and clear lacquer are preferably applied wet-on-wet, i.e. after a flash-off period for the base lacquer, optionally with application of heat, and after subsequent application of a clear lacquer, the base lacquer is baked together with the clear lacquer, as is, for example, described in EP-A-0 038 127 and 0 402 772. Suitable clear lacquers in this connection are, for example, described in EP-A-0 038 127 and 0 184 761. These are systems based on binders which crosslink by addition or condensation reactions, for example binders which crosslink with melamine resins or isocyanate derivatives.

Multi-coat lacquer coatings with several clear lacquer coats have been described in recent times. Such an approach allows the production of lacquer coatings with better optical properties.

Multi-coat lacquer coatings are described in DE 38 39 905 C2, in which two solvent-based clear lacquer coats are applied to a pigmented coat. Such lacquer coatings have proved to be in need of improvement both in terms of their chemical resistance and their optical impression.

EP-A-0 402 181 describes the production of a multi-coat lacquer coating by application of several clear lacquer coats on top of a base lacquer. Heat-curing clear lacquers based on hydroxy-functional acrylate resins as the binder and melamine resins or isocyanates as the crosslinking agent are described. The clear lacquer coats produced from heat-curing clear lacquers are, however, in need of improvement in terms of their chemical resistance and mechanical strength, for example scratch resistance.

DE-A-41 33 290 thus describes a process for the production of a multi-coat lacquer coating by applying a radiation-curing clear lacquer onto a dried base lacquer. These clear lacquer coats are characterized by improved chemical resistance.

If the above-mentioned increased standards are set for optical quality (depth, high DOI values), then the clear lacquer coatings must be applied in total coat thicknesses of at least 50 μm. At such high coat thicknesses, the high volume shrinkage of radiation-curing lacquers on hardening is problematic. At high coat thicknesses, stresses arise in the film and impaired adhesion to the underlying basecoat or running-away is observed. Moreover, on vertical surfaces an increased tendency to sagging may be noted at high coat thicknesses. Such an approach is uneconomic due to the high price of radiation-curing coating compositions in comparison with customary heat-curing lacquers.

The object of the invention was to make available a process for the production of multi-coat coatings with high chemical resistance and the fulfilment of increased optical quality requirements.

This object is achieved by a process for the production of multi-coat lacquer coatings, in which at least one heat-curing clear lacquer coat is applied onto a pigmented base coat and is crosslinked by heat, and which is characterized in that a further clear lacquer coat based on radiation-curing coating compositions is applied onto the clear lacquer coat and is subsequently crosslinked with actinic radiation.

It is optionally possible to perform the radiation curing in stages. It is also preferably possible to perform thermal crosslinking in addition to the radiation-induced crosslinking.

Generally known base lacquers may act as base lacquers. Examples of these are solvent-based, aqueous or powder basecoats. Water-thinnable base lacquers are preferred. The basecoats contain customary physically drying and/or chemically crosslinking binders, inorganic and/or organic colored pigments and/or effect pigments, such as, for example, metallic or pearlescent pigments together with further auxiliary substances customary in lacquers, such as, for example, catalysts, flow-control agents or anti-cratering agents. Polyester, polyurethane or acrylate resins are preferably used as the basis for the basecoat binder. These binders may optionally be crosslinked with crosslinking agents, for example melamine or isocyanate derivatives. The basecoats are applied either directly onto customary substrates or onto precoated substrates in a coat thickness of 10–30 μm, preferably less than 20 μm. Before application of the basecoat, the substrates may be provided with, for example, customary priming, filler and intermediate coats, as are customary, for example, in multi-coat lacquer coatings in the automotive sector.

The base lacquer coat is overcoated with heat-curing clear lacquer. Any customary heat-curable clear lacquer coating compositions which are not curable with actinic radiation may be used as the clear lacquer. Examples are clear powder coatings, clear lacquers dissolved in solvents, low-solvent and solvent-free clear lacquers and water-thinnable clear lacquers. They may be single- or multi-component, self crosslinking or extrinsically crosslinking. Polyesters, polyurethanes and (meth)acrylic copolymers may, for example, be used as the basis for the binder of these clear lacquers. Examples of such clear lacquer coating compositions may be found in DE-A-39 10 829, DE-A-37 40 774, EP-A-0 038 127.

After application of the clear lacquer coating composition in a coat thickness of 20–80 μm, preferably 25–50 μm, the coat formed is dried or baked at elevated temperature so forming a base lacquer/clear lacquer two-coat coating. The base lacquer may here be previously dried at temperatures of up to 150° C. or, as a preferred embodiment of the process according to the invention, the clear lacquer coat is applied wet-on-wet to the base lacquer coat, whereupon both are dried or baked together.

The drying or baking process for the basecoat and heat-curing clear lacquer coat is performed in the process according to the invention in such a manner that the lower lacquer coats obtained contain only small proportions of volatile substances. Particularly during the radiation-induced crosslinking reaction of the further clear lacquer coat, there should remain no substantial proportions of volatile constituents in the underlying lacquer coats. Such constituents may disrupt gloss and adhesion in the upper radiation-curing clear lacquer film.

Before application of the radiation-curing clear lacquer coat, the underlying clear lacquer coat may, if desired, be sanded. Optionally, further heat-curing clear lacquer coats may be applied between the first heat-curing clear lacquer coat and the upper radiation-cured clear lacquer coat. If desired, particular optical effects may be achieved with these additional coats.

A radiation-curing coating composition is applied on top of the dried and crosslinked base and clear lacquer coats. Such coating compositions are known clear lacquers polymerizing by free-radical or/and cationic polymerization to which may be added customary additives. These lacquers are crosslinked by radiation.

Application of the radiation-curable lacquer may proceed by any customary spraying method, such as, for example, compressed air spraying, airless spraying, high speed rotary spraying, electrostatic spray application (ESTA), optionally combined with hot-spraying application, such as, for example, hot air spraying. This may be performed at temperatures of a maximum of 70°–80° C. such that suitable application viscosities are achieved and the brief exposure to heat causes no change to the lacquer material and to the overspray, which may optionally be reprocessed. Thus, the hot spraying process may be arranged such that the lacquer material is only briefly heated in or shortly before the spray nozzle.

The spray booth may, for example, be operated with an optionally temperature-controllable recirculation system, which is operated with an appropriate absorbent for the overspray, for example with the lacquer material. The spray boot consists of materials which ensure that there is no contamination of the material and which are not attacked by the circulating medium. Such measures mean that the overspray may be reprocessed.

The coating procedure is preferably performed under illumination with visible light of a wavelength in excess of 550 nm or with exclusion of light.

By avoiding light of a wavelength below 550 nm, the lacquer material used and the overspray are not affected. Direct reprocessing is therefore optionally possible. The recycling unit substantially comprises a filtration unit together with a mixing device, which maintains a controllable ratio of fresh lacquer material to be reprocessed and optionally recirculating lacquer material. Supply containers and pumps, together with control devices are also present. An addition device to maintain constant levels of volatile constituents, such as for example proportions of the organic solvent or the water, is also optionally required.

The radiation-curing clear lacquer is preferably applied in such a manner that dry coat thicknesses of preferably 10–50 μm, particularly preferably 15–35 μm, are achieved. The radiation-curing clear lacquer may, if desired, be applied in several coats.

After application of the radiation-curing clear lacquer coating composition, the coated substrate is subjected to the crosslinking process, optionally after a standing period. The purpose of the standing period is to allow, for example, flow-out, degassing of the lacquer film or evaporation of volatile constituents such as solvent, water or $CO_2$, if the lacquer material was, for example, applied with supercritical carbon dioxide as the solvent, as is described, for example, in EP-A-0 321 607. It is also possible to promote the standing period with elevated temperatures of up to 80° C., preferably up to 60° C.

The actual radiation curing process may be performed either with UV radiation or electron beams or with other sources of radiant actinic radiation. An inert gas atmosphere is preferably used with electron beams. This may, for example, be achieved by supplying $CO_2$, $N_2$ or by using a mixture of both directly onto the substrate surface.

UV curing may also be performed under inert gas. If protective gas is not used, ozone may be produced. This may, for example, also be removed by extraction.

Radiation curing may be performed using customary radiation sources, optical auxiliary measures, customary durations and customary measures for controlling the irradiation process and also using customary arrangements of the radiation sources under conventional conditions familiar to the person skilled in the art. UV radiation and electron beam sources are preferably used.

According to the invention, irradiation may be performed such that thorough crosslinking of the radiation-curing clear lacquer coat proceeds in one stage. It may, however, also be favorable initially to pregel the coating film by UV-induced crosslinking, for example using black light irradiation in a first zone, and subsequently crosslinking in a second or several further stages, for example with renewed UV-irradiation or electron beam irradiation.

The arrangement of the radiation sources is known in principle, it may be adapted to the particular features of the workpiece and process parameters.

A problem with coating articles of a complicated shape, such as, for example, automotive bodies, with radiation-curing lacquer systems is curing areas which are not directly accessible to the radiation (shadowed areas), such as, for example, cavities, grooves and other undercuts determined by the design. This problem may be solved, for example, by using point, small area and omnidirectional radiation sources together with an automatic moving device to irradiate interiors, engine compartments, cavities or edges.

It is additionally possible to use thermal activation for crosslinking the coating composition. When using free-radical polymerizable coating compositions, it may be favorable to this end to use thermally activatable free-radical initiators such that thermally activated free-radical polymerization may be performed subsequently to or simultaneously with the irradiation.

When using cationically polymerizable coating compositions, it is not necessary to use special thermally activatable initiators. The cationic polymerization initiated by the radiation energy is self-propagating. It may, nonetheless, still be favorable to apply heat in this case too.

The lacquer systems which may be used for the upper clear lacquer coat according to the invention are customary radiation-curing coating compositions which crosslink by free-radical or cationic polymerization or combinations thereof. High-solids aqueous systems present as emulsions are a preferred embodiment. Coating compositions containing solvents may, however, also be used. Particularly preferably, these are 100% lacquer systems, which may be applied without solvent and without water. The radiation-curing clear lacquers may be formulated as topcoat lacquers which are unpigmented or, if desired, transparently colored with soluble dyes.

Radiation-curing clear lacquer coating compositions which are known in principle and are described in the literature may be used according to the invention. These are either free-radical curing systems, i.e. free radicals are produced by the action of radiation on the coating composition and then initiate the crosslinking reaction, or the coating compositions are cationically curing systems in which Lewis acids are formed from initiators by irradiation, which acids initiate the crosslinking reaction.

The free-radical curing systems are, for example, prepolymers, as polymers or oligomers, having olefinic double bonds in the molecule. These prepolymers may optionally be dissolved in reactive diluents, i.e. reactive liquid monomers. Coating compositions of this type may additionally contain, for example, customary initiators, light stabilizers, transparent pigments, soluble dyes and/or other lacquer auxiliaries.

Examples of prepolymers or oligomers are (meth)acrylic-functional (meth)acrylic copolymers, epoxy resin (meth)acrylates, which contain no aromatic structural units, polyester (meth)acrylates, polyether (meth)acrylates, polyurethane (meth)acrylates, unsaturated polyesters, amino (meth)acrylates, melamine (meth)acrylates, unsaturated polyurethanes or silicone (meth)acrylates. The molecular weight (number average $\overline{Mn}$) is preferably in the range from 200 to 10000, particularly preferably from 500 to 2000. (Meth)acrylic means both here and below acrylic and/or methacrylic.

If reactive diluents are used, they are generally employed in amounts of 1–70 wt. %, preferably 5–40 wt. %, related to the total weight of prepolymers and reactive diluents. They may be mono-, di- or polyunsaturated. Examples of such reactive diluents are: (meth)acrylic acid and the esters thereof, maleic acid and the semi-esters thereof, N-vinylpyrrolidone, vinyl acetate, vinyl ethers, substituted vinyl ureas, alkene glycol di(meth)acrylate, polyethylene glycol di(meth)acrylate, 1,3-butanediol di(methacrylate), vinyl (meth)acrylate, allyl (meth)acrylate, glycerol tri(meth)acrylate, trimethylolpropane tri(meth)acrylate, styrene, vinyl toluene, divinyl benzene, pentaerythritol tri(meth)acrylate, pentaerythritol tetra(meth)acrylate, dipropylene glycol di(meth)acrylate and hexanediol di(meth)acrylate and mixtures thereof. These substances are used to influence viscosity and lacquer properties, such as, for example, crosslink density.

Photoinitiators for free-radical curing systems may, for example, be used in amounts of 0.1–5 wt. %, preferably 0.5–4 wt. %, related to the total of free-radical polymerizable prepolymers, reactive diluents and initiators. It is favorable if their absorption is in the wavelength range 260–450 nm. Customary photoinitiators familiar to the person skilled in the art may be used. Examples of photoinitiators are benzoin and derivatives, benzil and derivatives, benzophenone and derivatives, acetophenone and derivatives, for example 2,2-diethoxyacetophenone, thioxanthone and derivatives, anthraquinone, 1-benzoylcyclohexanol, organophosphorus compounds such as, for example acylphosphine oxide. The photoinitiators may be used alone or in combination. Moreover, further synergistic components, for example tertiary amines, may be used.

If required, for example for irradiation with black light tubes, customary sensitizes, such as for example anthracene, may be used in customary amounts in conjunction with the photoinitiators. Optionally, customary thermally activatable free-radical initiators may also additionally be used. From 80°–120° C., these substances form free radicals which then initiate the crosslinking reaction. Examples of thermolabile free-radical initiators are: organic peroxides, organic azo compounds or C—C decomposing initiators, such as dialkyl peroxides, peroxo carboxylic acids, peroxo dicarbonates, peroxide esters, hydroperoxides, ketone peroxides, azodinitriles or benzopinacolesilyl ether. C—C decomposing initiators are particularly preferred because no gaseous decomposition products which could cause imperfections in the lacquer coat are formed during thermal decomposition. Preferred amounts to be used are between 0.1–5 wt. % related to the total of free-radical polymerizable prepolymers, reactive diluents and initiators. The initiators may also be used as a mixture.

Binders for cationically polymerizable coating compositions are, for example, polyfunctional epoxy oligomers containing more than two epoxy groups per molecule. It is favorable if the binder contains no aromatic structures. Such epoxy oligomers are described, for example, in DE-A-36 15 790. They are, for example, polyalkene glycol diglycidyl ethers, hydrogenated bisphenol-A glycidyl ethers, epoxyurethane resins, glycerol triglycidyl ethers, diglycidyl hexahydrophthalate, diglycidyl esters of dimeric acids, epoxidized derivatives of (methyl)cyclohexane, such as for example 3,4-epoxycyclohexyl-methyl(3,4-epoxycyclohexane) carboxylate or epoxidized polybutadiene. The number average molecular weight of the polyepoxide compounds is preferably below 10000.

If low viscosities are required for application, viscosity may be adjusted by reactive diluents, i.e. reactive liquid compounds, for example reactive monomers, such as cyclohexene oxide, butene oxide, butanediol divinyl ether, butanediol diglycidyl ether or hexanediol diglycidyl ether. Further examples of reactive solvents are alcohols, polyalkene glycols, polyalcohols, hydroxy-functional polymers, cyclic carbonates or water. These may also contain dissolved solid constituents, such as for example solid polyalcohols, such as trimethylolpropane.

Photoinitiators for cationically curing systems are used alone or in combination in amounts of 0.5–5 wt. %, related to the total of cationically polymerizable prepolymers, reactive diluents and initiators. These are substances, known as onium salts, which on irradiation photolytically release Lewis acids. Examples of these are diazonium salts, sulphonium salts or iodonium salts. Triarylsulphonium salts are particularly preferred.

The binders susceptible to radiation-induced curing may, apart from the functional groups typical of them, also contain further functional groups in their molecules, such as, for example, hydroxyl, oxyrane or isocyanate groups, which are accessible to chemical crosslinking. In these cases, external crosslinking agents, such as for example aminoplast crosslinking agents, optionally blocked polyisocyanates, curing agents containing carboxyl groups, ketimine crosslinking agents which decompose on entry of atmospheric moisture, polyamine or polyamidoamine curing agents are added in a suitable amount. The above-mentioned functional groups typical of radiation-curable binders—oxyrane groups, polymerizable C=C. double bonds—may additionally be drawn upon, also in terms of a polyaddition reaction, for the radiation-induced curing reaction by the addition of suitable crosslinking agents. Examples of such crosslinking agents are polyamine curing agents, polyamidoamine curing agents, moisture-decomposable ketimine crosslinking agents, CH-acid compounds, which may have a crosslinking action in terms of a Michael addition.

Apart from the stated crosslinking agents, binders which are not susceptible to radiation-induced curing may also be added to the radiation-curable clear lacquers, which binders permit an additional, non radiation-induced curing reaction, as already mentioned above, thanks to suitable functional groups. Examples of such functional groups are the above-mentioned further functional groups contained in the molecule of the radiation-curable binder.

Examples are the clear lacquers susceptible to radiation-induced curing described in EP-A-O 247 563 which additionally contain an OH-functional binder and a polyisocyanate curing agent and are thus cured by two combined curing mechanisms. These may also be used in the process according to the invention.

Non-reactive solvents for free-radical and cationically curing systems are customary lacquer solvents, such as esters, ethers, ketones, for example butyl acetate, ethylene glycol ether, methyl ethyl ketone, methyl isobutyl ketone and aromatic hydrocarbons. $C_2$–$C_4$ alkanols and preferably water are also suitable solvents for free-radical polymerizable systems.

Light stabilizers are preferably added to the clear lacquers according to the invention. Examples of these are phenyl salicylates, benzotriazole and derivatives, HALS compounds together with oxalanilide derivatives and combinations thereof Customary concentrations are 0.5–5 wt. %, preferably 1–2 wt. % related to the total clear lacquer. When selecting the light stabilizer, care must be taken to ensure that initiation of crosslinking is not impaired by the light stabilizer and that the light stabilizers used are stable with respect to the radiation used in the radiation curing process.

Further additives are, for example, elasticizing agents, polymerization inhibitors, defoamers, flow-control agents, anti-oxidants, transparent dyes, optical brighteners and adhesion additives, such as for example phosphoric acid esters and/or silanes.

Optionally, transparent, colorless extenders and/or pigments may be added to the coating composition. The quantity is up to 10 wt. %, related to the complete clear lacquer. Examples are silicon dioxide, mica, magnesium oxides, titanium dioxide or barium sulphate. Particle size is preferably below 200 nm. With UV-curable systems, care must be taken to ensure that, at the coat thickness used, the coating film is still transparent to UV radiation.

Production processes for suitable radiation-curing clear lacquer coating compositions are known. It is possible to combine systems with differing radiation-induced chemical crosslinking mechanisms. Different free-radical curing crosslinking systems or cationically curing crosslinking systems or free-radical and cationically curing crosslinking may be combined with each other. The radiation-curing clear lacquers may, for example, also advantageously contain such constituents as permit an additional curing mechanism to the already described radiation-inducible free-radical and/or cationic crosslinking mechanism. This approach permits combined curing of the upper clear lacquer coat applied according to the invention by radiation-induced and non radiation-induced crosslinking reactions which proceed in parallel or sequentially. The non radiation-induced crosslinking reaction serves here to provide an additional crosslinking or post-crosslinking. Examples of such non radiation-induced mechanisms are polyaddition and poly-condensation reactions. These additional curing reactions may be performed, for example, at elevated temperature up to 180° C.

The radiation-curable clear lacquers used according to the invention may be one or two component formulations depending on the selected additional crosslinking mechanism. Care should be taken to select the composition such that the radiation-curable clear lacquer or the components of a multi-component radiation-curable clear lacquer are stable in storage. Different reaction initiation processes may also be combined, for example UV with UV curing, UV with thermal initiation or electron beam curing with UV curing.

The various crosslinking reactions may be initiated with mixtures of the corresponding initiators. By way of example, mixtures of photoinitiators with differing absorption maxima are possible. In this manner, different emission maxima of one or more radiation sources may be exploited. This may proceed simultaneously or sequentially. Thus, for example, curing may be initiated with the radiation from one radiation source and continued with the radiation from another. The reaction may then be performed in two or multiple stages, which may, for example, also be spatially separate. The radiation sources used may be the same or different.

It is possible according to the invention initially to perform a radiation-induced crosslinking reaction and subsequently or simultaneously a thermally-induced crosslinking reaction. To this end, if desired, apart from one or more photoinitiators, one or more thermally decomposing initiators may also be used. The use of photoinitiators is not necessary with electron beam curing.

The two or multiple stage procedure may be favorable in order, for example, initially to achieve gelation, by which means, for example, sagging on lacquer coated vertical surfaces may be avoided. Gelation is also favorable with systems containing solvents, in order to allow the solvent to flash off.

Photoinitiators are preferably selected such that they do not break down due to the action of visible light with a wavelength in excess of 550 nm. When using thermally decomposing initiators, these should be selected such that they do not break down under the application conditions for the lacquer material. It is possible in this manner to reprocess and use the coating composition overspray directly, since any chemical reaction is avoided during application.

The crosslink density of the lacquer film may be adjusted via the functionality of the binder constituents used. Selection may be made such that the crosslinked clear lacquer coating has sufficient hardness, and an excessive level of cross-linking is avoided in order to prevent excessively brittle films.

The multi-coat lacquer coating obtained according to the invention displays good intercoat adhesion between the individual coats. An increased total coat thickness of the clear lacquer coating is possible, and clear lacquers exhibiting differing properties may also be used. Consequently, particular optical properties, for example better gloss, better structureless surface, are to be achieved. It is also possible by means of the present process to combine two clear lacquer coats which contain different, mutually incompatible additives. Examples of such combinations are a clear lacquer coat containing a basic additive (for example a light stabilizer) as the lower clear lacquer coat in combination with an upper clear lacquer coat containing an acidic additive (for example also a light stabilizer). Advantages moreover come about due to the possible rapid crosslinking reaction of the outer clear lacquer coat in terms of sensitivity to external influences, for example dust inclusions, on the lacquer.

Using the process according to the invention, non-yellowing multi-coat coatings with high resistance to chemicals, good scratch resistance and high optical quality (depth, gloss) are obtained. In particular, structureless surfaces are achieved. This may be seen, by way of example, from the following examples, which show particularly high DOI values for the lacquer coatings according to the invention. The overspray of the radiation-curing coating composition used in the process according to the invention is suitable for direct re-use.

The process according to the invention is particularly suitable for use in motor vehicle mass-production lacquer coating. Metal or plastic parts, such as for example automotive bodies and the parts thereof, are particularly suitable substrates.

The following examples illustrate the invention.

Production of radiation-curable clear lacquers (Examples 1–4)

Example 1

A radiation-curable clear lacquer coating composition was produced by mixing together 3124 g of an ethoxylated trimethylolpropane triacrylate, 616 g of an aliphatic urethane acrylate with a double bond functionality of 2 and a polymerizable C=C double bond content of 1 mole per kg, 3790 g of a polyester acrylate with a double bond functionality of 3.5 and a polymerizable C=C double bond content of 3.9 moles per kg, 332 g of tripropylene glycol diacrylate, 332 g of 2-hydroxy-2-methyl-1-phenylpropan-1-one, 8 g of a silicone diacrylate, 966 g of nonyl acrylate and 832 g of hexyl acrylate.

Example 2

In a manner analogous to example 1, a radiation-curable clear lacquer coating composition was produced from 28 parts of a multi-functional urethane acrylate with a molar mass of 4500, a polymerizable C=C double bond content of 2.5 moles per kg and a hydroxyl number of 150 mg KOH/g, 19 parts of dipropylene glycol diacrylate, 48 parts of tripropylene glycol diacrylate, 4 parts of 2-hydroxy-2-methyl-1-phenylpropan-1-one and 1 part of a 10% solution of a silicone oil in toluene ("OL" silicone oil from the Bayer company).

Example 3

In a manner analogous to example 1, a radiation-curable clear lacquer coating composition was prepared from 24 parts of the multi-functional urethane acrylate from example 2, 16 parts of a multi-functional melamine acrylate with a molar mass of 900 and a polymerizable C=C double bond content of 5.5 moles per kg, 16 parts of dipropylene glycol diacrylate, 39 parts of tripropylene glycol diacrylate, 4 parts of 2-hydroxy-2-methyl-1-phenyl-propan-1-one and 1 part of the silicone oil solution from example 2.

Example 4

In a manner analogous to example 1, a radiation-curable and heat-curable clear lacquer coating composition was produced from 52 parts of a 60% solution of a difunctional polyester acrylate with a molar mass of 1300 in dipropylene glycol diacrylate with an acid number related to the solution of 18 mg KOH/g and a hydroxyl number related to the solution of 150 mg KOH/g, 35 parts of phenoxyethyl acrylate, 4 parts of 2-hydroxy-2-methyl-1-phenyl-propan-1-one, 0.2 parts of a commercial flow-control agent (BYK 310 from the BYK company) and 8.8 parts of hexamethoxymethylmelamine.

Production of multi-coat lacquer coatings: (Examples 5–8 and comparative tests A and B)

Comparative test A

A sheet of metal cathodically electrocoated with primer (20 μm) and precoated with commercial filler (35 μm) was spray coated with a customary metallic basecoat lacquer containing solvent to a dry film thickness of 10 μm, after 5 minutes' flash-off at 20° C. the sheet was overcoated wet-on-wet with a customary one-component acrylate resin/melamine resin based clear lacquer containing solvent to a dry coat thickness of 35 μm and was baked for 25 minutes at 135° C. The same one-component clear lacquer was then applied by spraying to a dry coat thickness of 35 μm and baked for 25 minutes at 135° C. On examination of the glossy surface, structure could be discerned.

Example 5

Comparison test A was repeated in an analogous manner, with the difference that, instead of a second clear lacquer coat based on the one-component clear lacquer, the radiation-curable clear lacquer from example 1 was applied by spraying to a dry film thickness of 35 μm. The horizontal test metal sheet was then irradiated at a conveyor speed of 1 m/min with two medium pressure mercury lamps each with a power output of 100 W/cm at a distance of 10 cm from the surface to be cured (irradiation time thus approximately 10 seconds). There was no perceptible structure on examination of the high-gloss surface.

Comparative test B

A sheet of metal cathodically electrocoated with primer (20 μm) and precoated with commercial filler (35 μm) was spray coated with a customary single colored water-based lacquer to a dry film thickness of 15 μm; after 5 minute's flash-off at 60° C. followed by 5 minutes' flash-off at 100° C., the test-piece was overcoated wet-on-wet with a customary one-component acrylate resin/melamine resin based clear lacquer containing solvent to a dry coat thickness of 35 μm and was baked for 10 minutes at 140° C. The same one-component clear lacquer was then applied by spraying to a dry coat thickness of 35 μm and baked for 20 minutes at 140° C. On examination of the glossy surface, structure could be discerned.

Example 6

Comparison test B was repeated in an analogous manner, with the difference that, instead of a second clear lacquer coat based on the one-component clear lacquer, a clear lacquer produced by mixing 90 parts of the radiation-curable clear lacquer from example 2 and 10 parts of a polyisocyanate curing agent (Desmodur N/75 from the Bayer company) was applied by hot-spraying at 60° C. onto the test metal sheet preheated to 60° C. to a dry coat thickness of 35 μm. The horizontal test metal sheet was then irradiated at a conveyor speed of 1 m/min with two medium pressure mercury lamps each with a power output of 100 W/cm at a distance of 30 cm from the surface to be cured (irradiation time approximately 10 seconds). The test piece was then post-cured for 20 min at 140° C. A high-gloss surface without perceptible structure was obtained.

Example 7

Comparison test B was repeated in an analogous manner, with the difference that, once applied, the first one-component coat was cured for 20 minutes at 140° C. and subsequently instead of a second clear lacquer coat based on the one-component clear lacquer, the radiation-curable clear lacquer from example 3 was applied by hot-spraying at 60° C. onto the test metal sheet preheated to 60° C. to a dry film thickness of 35 μm. The test piece was then radiation-cured as described in example 6. Thermal post-curing as in example 6 was not performed. A high-gloss surface without perceptible structure was obtained.

Example 8

Comparison test B was repeated in an analogous manner, with the difference that instead of a second clear lacquer coat based on the one-component clear lacquer, the radiation-curable clear lacquer from example 4 was applied by hot-spraying at 60° C. onto the test metal sheet preheated to 60° C. to a dry film thickness of 35 μm. Radiation curing and the subsequent thermal post-curing were performed as described in example 6. The high-gloss surface obtained had no perceptible structure.

Comparative test C

Comparative test A was repeated with the difference that, instead of the two clear lacquer coats based on the one-component clear lacquer, the radiation-curable clear lacquer from example 1 was applied by spraying to a dry coat thickness of 35 μm.

The horizontal test metal sheet was then irradiated at a conveyor speed of 1 m/min with two medium pressure mercury lamps each with a power output of 100 W/cm at a distance of 10 cm from the surface to be cured (irradiation time thus approximately 10 seconds). Slight structure was perceptible on examination of the high-gloss surface.

Comparative test D

Comparative test C was repeated in an analogous manner. A further coat based on the radiation-curable clear lacquer from example 1 was additionally applied by spraying, also to a dry coat thickness of 35 μm. Radiation curing was performed analogously. No structure was perceptible on examination of the high-gloss surface, but yellowing was perceptible in comparison with the multi-coat structures obtained in example 5 and in comparative tests A and C.

The test results are compiled in table 1.

TABLE 1

| Example | DOI | Acid resistance[1)] | Xylene resistance[2)] | Acetone resistance[3)] | Scratch hardness[4)] |
|---|---|---|---|---|---|
| 5 | 90 | OK | OK | OK | — |
| 6 | 93 | OK | OK | OK | 2.0 N |
| 7 | 94 | OK | OK | OK | 3.0 N |
| 8 | 93 | OK | OK | OK | 3.5 N |
| Comparative test A | 87 | badly corroded | OK | Swelling (may be scratched off) Not OK | — |
| Comparative test B | 86 | badly corroded | Swelling (may be scratched off) | Swelling (may be scratched off) Not OK | 2.0 N |
| Comparative test C | 85 | OK | OK | OK | — |
| Comparative test D | 88 | OK | OK | OK | — |

The examples according to the invention display a smooth, high-gloss surface. The comparative tests A, B and C produce surfaces which still have an optically perceptible structure. Comparative test D gives rise to noticeable yellowing.

1) 40% sulphuric acid, 15 min., 60° C. (temperature of object) OK=no optical change
2) A xylene-soaked swab is placed on the lacquered surface at room temperature and covered with a watchglass for 5 minutes. OK=no/little optical change
3) An acetone-soaked swab is placed on the lacquered surface at room temperature and covered with a watchglass for 5 minutes. OK=no/little optical change
4) According to Kittel, Lehrbuch der Lacke und Beschichtungen, volume VIII, part 1, 1980, p. 178 (Clemen test).

We claim:

1. A process for the production of a multi-coat lacquer coating by applying a clear lacquer coat onto a substrate provided with a pigmented base lacquer coat and subsequent curing of the clear lacquer coat wherein at least one heat-curable clear lacquer coat is applied onto the base lacquer coat, which is thermally cured, and then at least one further clear lacquer coat of a radiation-curable coating composition is applied and this coat is cured by UV radiation or electron beam irradiation.

2. A process according to claim 1 wherein curing the clear lacquer coat of the radiation-curable coating composition further comprises exposure to heat.

3. A process according to claim 1 wherein the clear lacquer coat of the radiation-curable coating composition is cured with UV radiation and contains at least one photoinitiator.

4. A process according to claim 2, wherein the radiation-curable clear lacquer coating composition is used which additionally contains at least one thermally activatable free-radical initiator.

5. A process according to claim 1 wherein the multi-coat lacquer coating is applied to motor vehicle bodies and the parts thereof.

* * * * *